US010798788B2

(12) United States Patent
Westin et al.

(10) Patent No.: US 10,798,788 B2
(45) Date of Patent: Oct. 6, 2020

(54) HEATER AND METHOD FOR THAWING/WARMING A PERISHABLE DIELECTRIC LOAD

(71) Applicant: Antrad Medical AB, Kista (SE)

(72) Inventors: Pierre Westin, Täby (SE); Joachim Sällvin, Saltsjö-Boo (SE); Anders Björkman, Sundbyberg (SE)

(73) Assignee: Antrad Medical AB, Finlandsgatan (SE)

( * ) Notice: Subject to any disclaimer, the term of this patent is extended or adjusted under 35 U.S.C. 154(b) by 265 days.

(21) Appl. No.: 16/069,269

(22) PCT Filed: Jan. 12, 2017

(86) PCT No.: PCT/SE2017/050027
§ 371 (c)(1),
(2) Date: Jul. 11, 2018

(87) PCT Pub. No.: WO2017/123145
PCT Pub. Date: Jul. 20, 2017

(65) Prior Publication Data

US 2019/0014624 A1 Jan. 10, 2019

(30) Foreign Application Priority Data

Jan. 12, 2016 (SE) ..... 1650029

(51) Int. Cl.
*H05B 6/50* (2006.01)
*H05B 6/62* (2006.01)

(52) U.S. Cl.
CPC ..... *H05B 6/50* (2013.01); *H05B 6/62* (2013.01)

(58) Field of Classification Search
CPC ... H05B 6/50; H05B 6/62; H05B 6/80; H05B 6/802; H05B 6/806; H05B 6/00;
(Continued)

(56) References Cited

U.S. PATENT DOCUMENTS 3,518,393 A 6/1970 Mannar et al.
4,801,777 A 1/1989 Auerbach

FOREIGN PATENT DOCUMENTS

EP 0261007 3/1988
GB 2457494 8/2009
(Continued)

OTHER PUBLICATIONS

International Search Report for corresponding Patent Application No. PCT/SE2017/050027 dated Mar. 27, 2017.
(Continued)

*Primary Examiner* — Shawntina T Fuqua
(74) *Attorney, Agent, or Firm* — Renner, Otto, Boisslle & Sklar, LLP

(57) ABSTRACT

A heater (100) for thawing/warming a perishable dielectric load (130) contains: a heating chamber (140) for holding the perishable dielectric load (130) during thawing/warming thereof, a transmitter unit (110) generating electromagnetic energy (RFs) having predefined spectral properties, an emitting element (150) producing an electromagnetic field in the perishable dielectric load (130) based on the electromagnetic energy (RFs) from the transmitter unit (110), a tuning circuit (115) adjusting an overall impedance (Z) of the emitting element (150), the tuning circuit (115) and the heating chamber (140) so that the overall impedance (Z) matches an output impedance of the transmitter unit (110), and a control unit (120) measuring the overall impedance (Z) during thawing/warming of the perishable dielectric load (130) and repeatedly generating at least one control signal (Tn) causing the tuning circuit (115) to adjust the overall impedance (Z) to match the output impedance of the transmitter unit (110). The control unit (120) sets an initial value of the at least one control signal (Tn) based on an estimate (Vm) of a volume (V) of the perishable dielectric load (130).

13 Claims, 2 Drawing Sheets

(58) Field of Classification Search
CPC ..... A61M 5/445; A61M 5/46; A61M 5/48; A61M 5/44; A61M 2205/3686; A61M 1/025; G05D 23/24; F24H 1/225
See application file for complete search history.

(56) References Cited

FOREIGN PATENT DOCUMENTS

| | | |
|---|---|---|
| WO | 02/054833 | 7/2002 |
| WO | 11/145994 | 11/2011 |

OTHER PUBLICATIONS

F. Boström et al.; "Rapid thawing of fresh-frozen plasma with radio wave-based thawing technology and effects on coagulation factors during prolonged storage at 4° C."; Feb. 11, 2009; International Society of Blood Transfusion, Vox Sanguinis.

HEATER AND METHOD FOR THAWING/WARMING A PERISHABLE DIELECTRIC LOAD

This application is a national phase of International Application No. PCT/SE2017/050027 filed Jan. 12, 2017 and published in the English language, which claims priority to Swedish Patent Application No. 1650029-0 filed Jan. 12, 2016, which are hereby incorporated herein by reference.

THE BACKGROUND OF THE INVENTION AND PRIOR ART

The present invention relates generally to heating of perishable substances by means of electromagnetic fields. More particularly the invention relates to a heater according to the preamble of claim 1 and a corresponding method. The invention also relates to a computer program and a processor-readable medium.

There are many situations in which a substance is to be heated or thawed from a first temperature (e.g. below zero degrees Celsius) to a second temperature (e.g. room temperature). Sometimes it is also important that this heating is effected quickly and at very high precision, i.e. uniformly and without overheating any parts of the substance. In such cases, the heating task may become very challenging. Heating frozen blood plasma to a temperature suitable for introduction into the human body is one example of such heating. However, of course, both within and outside the medical field there are numerous other examples of demanding heating tasks, such as in advanced cooking.

WO 02/054833 shows an appliance for equalizing an electromagnetic field, which is not generated in a resonant cavity, and wherein a dielectric load being heated contains matters with one or more dielectric constants and loss factors.

WO 2011/145994 discloses another solution for equalizing a warming process wherein a load is heated via an electromagnetic field. Here, the load is surrounded by a field equalizing material. The load and the electromagnetic field are also moved relative to one another in order to enhance the heating process and render it more energy distribution more uniform.

WO 2011/159815 describes a solution according to which a dielectric load is heated from an initial temperature level to a desired final temperature level by using alternating electromagnetic energy from an energy source, which produces a predefined set of spectral components. A cavity contains the dielectric load, and an antenna transmits an electromagnetic field through the dielectric load. Mechanical processing means cause a relative movement between the dielectric load and the at least one antenna, thus varying a spatial relationship between the alternating electromagnetic field and the dielectric load. As a result, the electromagnetic energy is distributed relatively evenly in the dielectric load. Sensor means register a temperature level of the dielectric load; and based thereon an amount of energy is transmitted through the dielectric load.

EP 1 384 392 B1 describes a solution for the problem of overheating of perishable dielectric matters. Here, dielectric matters are warmed by being placed in oscillating electric and/or electromagnetic fields generated at frequencies being below 900 MHz between capacitor discs or in cavities.

PROBLEMS ASSOCIATED WITH THE PRIOR ART

Consequently, solutions are known for heating a perishable dielectric load by using an electromagnetic field and adapting the characteristics of the transmitter-antenna chain to the varying impedance of the perishable load. Nevertheless, there is yet no solution for establishing an adequate starting setting for the transmitter depending on the specific properties of the load to be heated.

SUMMARY OF THE INVENTION

The object of the present invention is therefore to solve the above problem, and thus offer a simple and reliable means for pre-calibrating an electromagnetic transmitter-antenna chain to a particular perishable load.

According to one aspect of the invention, the object is achieved by the above-described system, wherein the control unit is configured to set an initial value of the at least one control signal based on an estimate of a volume of the perishable dielectric load.

This system is advantageous because it ensures that the thawing/warming process starts off with a transmitter impedance that is well-adapted to the overall impedance of the perishable load and any surrounding conducting container. Thus, the total thawing/warming time required is shortened. The risk of damaging the perishable load and/or the heater due to severe impedance mismatching is also reduced significantly.

According to a preferred embodiment of this aspect of the invention, the heater contains a volume meter configured to register a value representing the estimate of the volume of the perishable dielectric load, and to forward the volume estimate to the control unit. Hence, the estimate of the volume of the perishable dielectric load is conveniently established. Of course, alternatively, the volume estimate may be entered by other means, such as manually (based on a visual indication on the load container), semi-automatically (e.g. by reading a bar code on the load container), or deduced from another parameter (e.g. from a weight indication combined with knowledge about the load's density).

Nevertheless, if a volume meter is used, according to one preferred embodiment of the invention, this meter includes at least one resilient member that is configured to be influenced by the perishable dielectric load in such a manner that a relatively large volume of the perishable dielectric load causes a comparatively large influence on the at least one resilient member (e.g. compression or extension of a helical spring), and conversely, a relatively small volume of the perishable dielectric load causes a comparatively small influence on the at least one resilient member. Consequently, it is straightforward to read out the value representing the volume estimate.

According to yet another preferred embodiment of this aspect of the invention, the heating chamber includes at least one conducting container configured to surround the perishable dielectric load in the heating chamber. Here, at least one of the at least one conducting container is arranged between the emitting element and the perishable dielectric load. The at least one conducting container holds dielectric matter, and it is configured to contact the perishable dielectric load, so as to bridge energy from the electromagnetic field from the emitting element into the perishable dielectric load during thawing/warming thereof. Thereby, a high degree of energy efficiency is attained.

According to still another preferred embodiment of this aspect of the invention, the volume meter further includes a pressure-to-force conversion member configured to convert a pressure exerted on the at least one conducting container by the perishable dielectric load into forces that influence the at least one resilient member. Consequently, a reliable volume reading can be generated.

According to a further preferred embodiment of this aspect of the invention, the tuning circuit contains at least one capacitive element and at least one inductive element which are adjustable in response to the at least one control signal. The setting of the initial value of the at least one control signal involves assigning an initial setting of the at least one inductive element. Namely, although of course it is advantageous if the capacitance has a suitable start value, it is more important that the tuning circuit has a well-adapted initial inductance.

According to still another preferred embodiment of this aspect of the invention, the control unit is configured to set the initial value of the at least one control signal on the further basis of: a weight estimate of the perishable dielectric load, a density estimate of the perishable dielectric load, a temperature estimate of the perishable dielectric load and/or an estimate of a ionic concentration in the perishable dielectric load. Namely, thereby an even more precise adaption to the initial load impedance can be achieved.

According to another aspect of the invention, the object is achieved by the method described above, wherein an initial value of the at least one control signal is set based on an estimate of a volume of the perishable dielectric load. The advantages of this method, as well as the preferred embodiments thereof, are apparent from the discussion above with reference to the proposed system.

According to a further aspect of the invention the object is achieved by a computer program loadable into the memory of at least one processor, and includes software adapted to implement the method proposed above when said program is run on at least one processor.

According to another aspect of the invention the object is achieved by a processor-readable medium, having a program recorded thereon, where the program is to control at least one processor to perform the method proposed above when the program is loaded into the at least one processor.

Further advantages, beneficial features and applications of the present invention will be apparent from the following description and the dependent claims.

BRIEF DESCRIPTION OF THE DRAWINGS

The invention is now to be explained more closely by means of preferred embodiments, which are disclosed as examples, and with reference to the attached drawings.

DESCRIPTION OF PREFERRED EMBODIMENTS OF THE INVENTION

Figure 1:
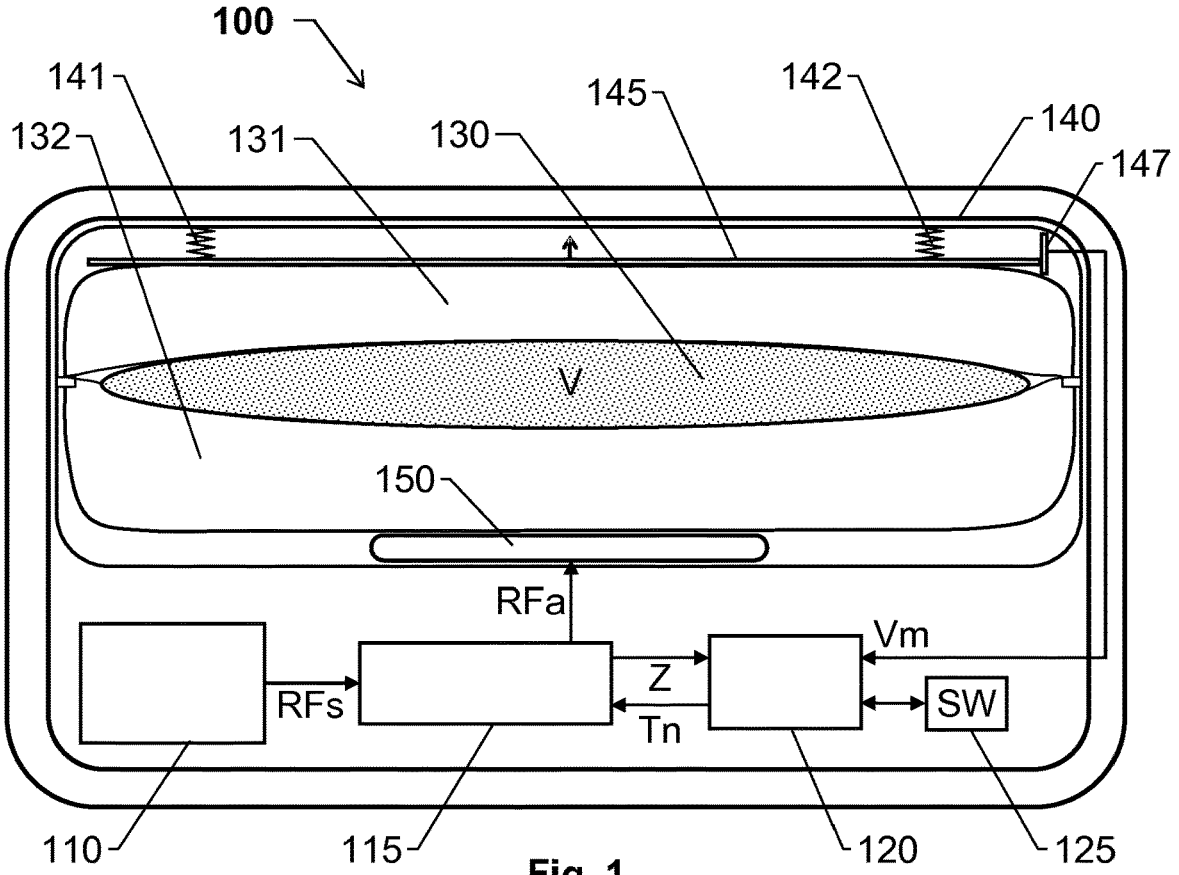
FIG. 1 shows a schematic side view of a heater according to one embodiment of the invention.

FIG. 1 shows a schematic side view of a heater 100 according to one embodiment of the invention for thawing/warming a perishable dielectric load 130.

The heater 100 includes a heating chamber 140, a transmitter unit 110, an emitting element 150, a tuning circuit 115 and a control unit 120.

The heating chamber 140 is configured to hold the perishable dielectric load 130 during thawing/warming thereof. The transmitter unit 110 is configured to generate electromagnetic energy RFs having predefined spectral properties, for example around 135 MHz. The emitting element 150 is configured to produce an electromagnetic field in the perishable dielectric load 130 based on the electromagnetic energy RFs from the transmitter unit 110.

Preferably, for enhanced energy efficiency, the heating chamber 140 also includes at least one conducting container, which here are exemplified by a first conducting container 131 above a container for the perishable dielectric load 130 and a second conducting container 132 below the container for the perishable dielectric load 130 relative to the emitting element 150. At least one of the conducting containers, here 132, is arranged between the emitting element 150 and the perishable dielectric load 130. The conducting containers 131 and 132 hold dielectric matter having a dielectric constant similar to that of the perishable dielectric load 130. The conducting containers 131 and 132 are further arranged to contact the perishable dielectric load 130, and thus efficiently bridge energy from the electromagnetic field from the emitting element 150 into the perishable dielectric load 130 during the thawing/warming process. Since the electromagnetic field generated by the emitting element 150 fills the entire heating chamber 140, the upper conducting container 131 basically performs the same task as the lower conducting container 132 in this respect.

The tuning circuit 115 is configured to repeatedly adjust an overall impedance Z of the emitting element 150, the tuning circuit 115 and the heating chamber 140 throughout the thawing/warming process, so that the overall impedance Z matches an output impedance of the transmitter unit 110. The tuning circuit 115 receives the electromagnetic energy RFs from the transmitter unit 110 and forwards a part of this electromagnetic energy RFa to the emitting element 150.

During thawing/warming of the perishable dielectric load 130, the control unit 120 is configured to measure the overall impedance Z, and repeatedly generate at least one control signal Tn, which is configured to cause the tuning circuit 115 to adjust the overall impedance Z to match the output impedance of the transmitter unit 110. For example, this may involve measuring an amount of reflected electromagnetic energy and adjusting an LC circuit in the tuning circuit 115 such that the LC circuit is in resonance, and thus good load matching is attained. Specifically, the control unit 120 is configured to set an initial value of the at least one control signal Tn based on an estimate Vm of a volume V of the perishable dielectric load 130. Thereby, it can be expected that the overall impedance Z matches the output impedance of the transmitter unit 110 fairly well already from the start.

For improved precision, the control unit 120 may be configured to set the initial value of the at least one control signal Tn on the further basis of at least one of: a weight estimate of the perishable dielectric load 130, a density estimate of the perishable dielectric load 130, a temperature estimate of the perishable dielectric load 130, and an estimate of a ionic concentration in the perishable dielectric load 130. Namely, in addition to the volume V, these parameters may also influence the impedance of the perishable load 130, and thus likewise the overall impedance Z.

According to one preferred embodiment of the invention, the heater 100 includes a volume meter that is configured to register a value representing the estimate Vm of the volume V of the perishable dielectric load 130. The volume meter is also configured to forward the value representing said estimate Vm to the control unit 120, such that the initial value of the at least one control signal Tn can be set based on the estimate Vm.

In FIG. 1, the volume meter is represented by a sensor 147 (e.g. resistive, capacitive, inductive or optic) which is arranged to register a position of a member 145 relative to a reference point, and thus determine the value of the estimate Vm.

The volume meter preferably also includes at least one resilient member, here represented by helical springs 141 and 142 respectively, configured to be influenced by the perishable dielectric load 130 in such a manner that a relatively large volume V of the perishable dielectric load 130 causes a comparatively large influence on the at least one resilient member 141 and 142, and a relatively small volume V of the perishable dielectric load 130 causes a comparatively small influence on the at least one resilient member 141 and 142. In FIG. 1, a relatively large volume V of the perishable dielectric load 130 will result in comparatively large compression of the helical springs 141 and 142; and conversely, a relatively small volume V of the perishable dielectric load 130 will result in comparatively small compression of the helical springs 141 and 142.

Further, as can be seen in FIG. 1, the perishable dielectric load 130 does not act directly upon the helical springs 141 and 142. Instead, the container for the perishable dielectric load 130 displaces the conducting containers 131 and 132, which have flexible delineating surfaces, and the upper conducting container 131, acts upon member 145, which, in turn, acts as a pressure-to-force conversion member, such that the pressure exerted on the conducting containers 131 and 132 by the perishable dielectric load 130 is converted into forces influencing the helical springs 141 and 142.

Figure 2:
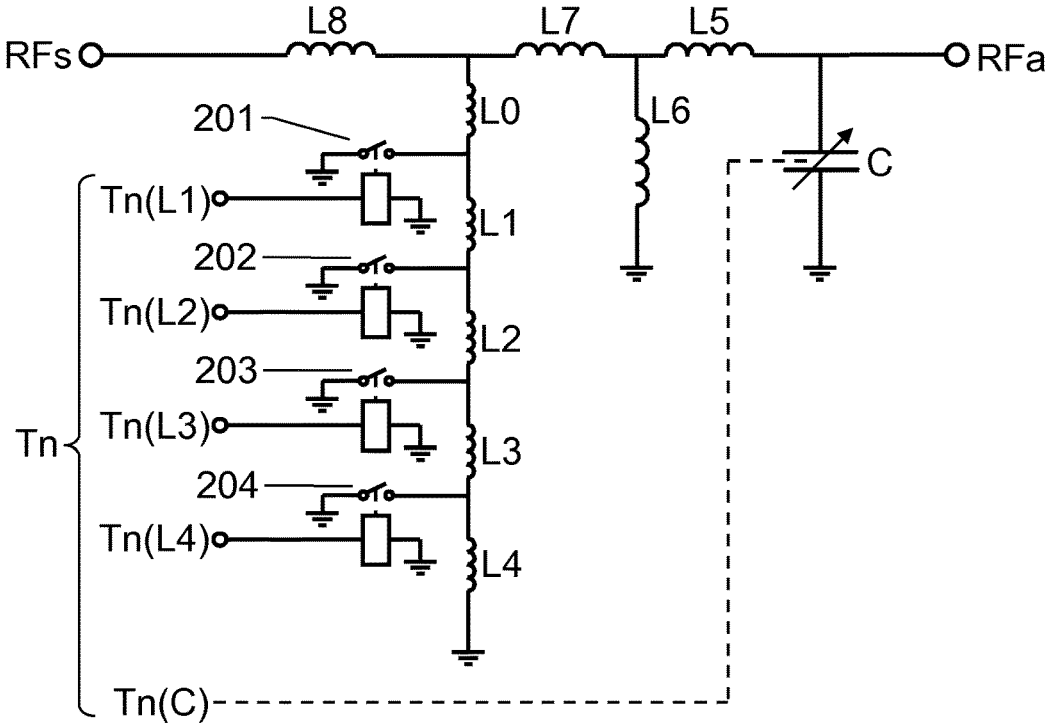
FIG. 2 schematically illustrates a tuning circuit according to one embodiment of the invention.

FIG. 2 shows a schematic circuit diagram over the tuning circuit 115 according to one embodiment of the invention.

The tuning circuit 115 includes a capacitive element C which is adjustable in response to the at least one control signal Tn from the control unit 120. In FIG. 2, this is exemplified by a control signal component Tn(C). The tuning circuit 115 also includes a set of inductive element L0, L1, L2, L3 and L4, which each is fixed, however, which via a relays 201, 202, 203 and 204 respectively, can be connected in various combinations to implement different resonance circuit configurations in response to the at least one control signal Tn from the control unit 120, thus causing an impedance adjustment. Hence, for convenient reference, the inductive elements L0, L1, L2, L3 and L4 may be referred to as "adjustable."

Here, this is exemplified by control signal components Tn(L1), Tn(L2), Tn(L3) and Tn(L4) respectively. The tuning circuit 115 further includes fixed inductances L5, L6, L7 and L8 to form a resonant circuit together with the inductive elements L0, L1, L2, L3 and L4 and the adjustable capacitive element C.

The main inductive parts of the resonance circuit are the inductances L5 and L6. All other inductances, except L8 which is the feeding point for incoming electromagnetic energy RFs, are connected in series and parallel to L6. By controlling the relays 201, 202, 203 and 204 via the at least one control signal Tn, the total Impedance from the conjunction point of L8, L7 and L0 and then through L0 may be varied.

For example, if no control signal component is active, the resonance circuit will have L0, L1, L2 L3 and L4 connected in series. If only the control signal component Tn(L4) is active, the resonant circuit includes the conductive element L4 connected in parallel with an impedance of a relay associated with the conductive element L4, while the remaining conductive elements L0, L1, L2 and L3 are not influenced. If instead the control signal components Tn(L3) and Tn(L4) are active, the resonant circuit includes L0, L1 and L2 in series plus a relay 203 in parallel with the conductive element L3 in series with the conductive element L4 in parallel with the relay 204.

One or more of the conductive elements L0, L1, L2, L3, L4, L5, L6, L7 and L8 may be represented by transmission lines. The adjustable capacitive element C may, in fact, be represented by a fixed capacitor, for example as part of the characteristics of the emitting element 150. In such a case, the control signal component Tn(C) is redundant, however adjusting the resonance frequency may need to be implemented differently, e.g. involving tuning the conductive elements L5 and/or L6, repositioning the emitting element 150, altering the geometry of the emitting element 150 and/or modifying the geometry of the heating chamber 140.

Consequently, the above-mentioned setting of the initial value of the at least one control signal Tn involves assigning an initial setting of the at least one inductive element L0, L1, L2, L3 and/or L4.

It is generally advantageous if the control unit 120 is configured to effect the above-mentioned procedure in a fully automatic manner, for instance by an executing computer program. Therefore, the control unit 120 may be communicatively connected to a memory unit 125 storing a computer program product SW, which, in turn, contains software for making at least one processor in the control unit 120 execute the above-described actions when the computer program product SW is run on the at least one processor.

Figure 3:
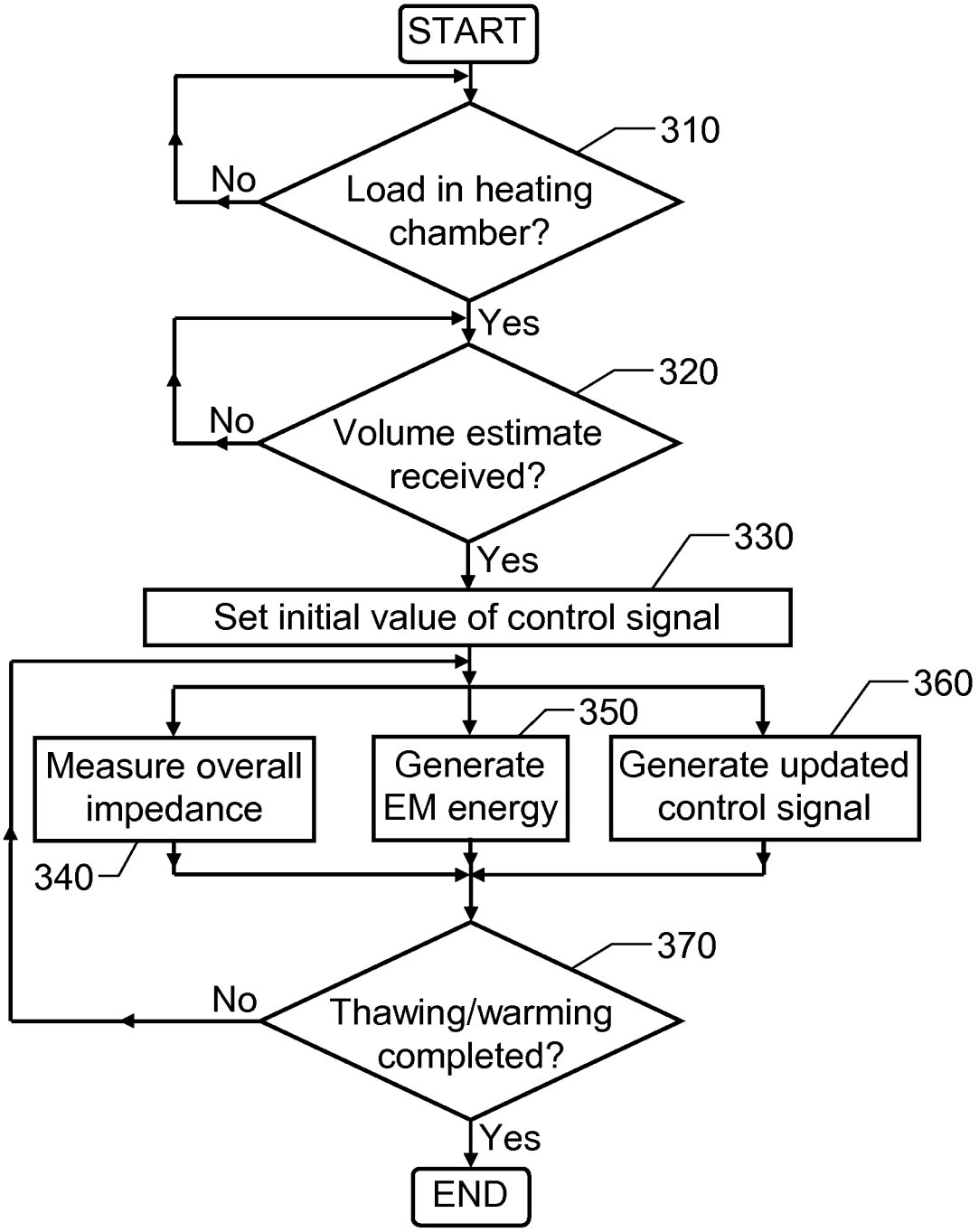
FIG. 3 illustrates, by means of a flow diagram, the general method according to the invention.

In order to sum up, and with reference to the flow diagram in FIG. 3, we will now describe the general method according to the invention.

In a first step 310, it is checked if a perishable dielectric load has been placed in the heating chamber; and if so, a step 320 follows. Otherwise, the procedure loops back, and stays in step 310.

In step 320, it is checked if an estimate of a volume of the perishable dielectric load has been received; and if so, a step 330 follows. Otherwise, the procedure loops back, and stays in step 320. As mentioned above, the estimate of the volume can be attained in various ways, for example via a volume meter in the heater, manual entry (based on a visual indication on the load container), semi-automatic entry (e.g. by reading a bar code on the load container), or by deduction from another parameter (e.g. from a weight indication combined with knowledge about the load's density).

In step 330, an initial value of at least one control signal for the tuning circuit is set based on the estimate of the volume of the perishable dielectric load. Thereafter, the thawing/warming process starts. This means that subsequent steps 340, 350, 360 and 370 are executed repeatedly in a looped manner.

In step 340, an overall impedance is measured, i.e. the combined impedance of the emitting element, the tuning circuit and the heating chamber (including the perishable dielectric load and any conducting containers). Preferably, the impedance is here measured by studying the amount of electromagnetic energy reflected back to the transmitter unit.

In step 350, preferably executed in parallel with step 340, electromagnetic energy with predefined spectral properties is generated by means of a transmitter unit, and fed to the perishable dielectric load via the emitting element.

In step 360, preferably executed in parallel with steps 340 and 350, at least one control signal is generated, which at least one control signal is configured to cause the tuning circuit to adjust the overall impedance to match the output impedance of the transmitter unit. This impedance adjustment may involve adjusting the resonance point of an LC circuit in a tuning circuit by generating the at least one control signal.

Then, step 370 checks if the thawing/warming process is completed, for instance by measuring a temperature of the perishable dielectric load. If, in step 370, it is found that the thawing/warming process is completed the procedure ends. Otherwise, the procedure loops back to steps 340, 350 and 360 for continued thawing/warming of the perishable dielectric load.

All of the process steps, as well as any sub-sequence of steps, described with reference to FIG. 4 above may be controlled by means of a programmed processor. Moreover, although the embodiments of the invention described above with reference to the drawings comprise processor and processes performed in at least one processor, the invention thus also extends to computer programs, particularly computer programs on or in a carrier, adapted for putting the invention into practice. The program may be in the form of source code, object code, a code intermediate source and object code such as in partially compiled form, or in any other form suitable for use in the implementation of the process according to the invention. The program may either be a part of an operating system, or be a separate application. The carrier may be any entity or device capable of carrying the program. For example, the carrier may comprise a storage medium, such as a Flash memory, a ROM (Read Only Memory), for example a DVD (Digital Video/Versatile Disk), a CD (Compact Disc) or a semiconductor ROM, an EPROM (Erasable Programmable Read-Only Memory), an EEPROM (Electrically Erasable Programmable Read-Only Memory), or a magnetic recording medium, for example a floppy disc or hard disc. Further, the carrier may be a transmissible carrier such as an electrical or optical signal which may be conveyed via electrical or optical cable or by radio or by other means. When the program is embodied in a signal which may be conveyed directly by a cable or other device or means, the carrier may be constituted by such cable or device or means. Alternatively, the carrier may be an integrated circuit in which the program is embedded, the integrated circuit being adapted for performing, or for use in the performance of, the relevant processes.

The term "comprises/comprising" when used in this specification is taken to specify the presence of stated features, integers, steps or components. However, the term does not preclude the presence or addition of one or more additional features, integers, steps or components or groups thereof.

The invention is not restricted to the described embodiments in the figures, but may be varied freely within the scope of the claims.

The invention claimed is:

1. A heater for thawing/warming a perishable dielectric load, the heater comprising:

a heating chamber configured to hold the perishable dielectric load during thawing/warming thereof, a transmitter unit configured to generate electromagnetic energy having predefined spectral properties, an emitter configured to produce an electromagnetic field in the perishable dielectric load based on the electromagnetic energy (RFs) from the transmitter, a tuning circuit configured to adjust an overall impedance of the emitter, the tuning circuit and the heating chamber so that the overall impedance matches an output impedance of the transmitter, and a controller configured to measure the overall impedance (Z) during thawing/warming of the perishable dielectric load and repeatedly generate at least one control signal configured to cause the tuning circuit to adjust the overall impedance to match the output impedance of the transmitter, wherein the controller is configured to set an initial value of the at least one control signal based on an estimate of a volume of the perishable dielectric load.

2. The heater according to claim 1, comprising a volume meter configured to:

register a value representing the estimate of the volume of the perishable dielectric load, and forward the value representing said estimate to the controller.

3. The heater according claim 1, wherein the heating chamber comprises at least one conducting container configured to surround the perishable dielectric load in the heating chamber, at least one of the at least one conducting container being arranged between the emitter and the perishable dielectric load, the at least one conducting container holding dielectric matter, and the at least one conducting container being configured to contact the perishable dielectric load so as to bridge energy from the electromagnetic field from the emitter into the perishable dielectric load during thawing/warming thereof.

4. The heater according to claim 1, wherein the volume meter comprises at least one resilient member configured to be influenced by the perishable dielectric load in such a manner that a relatively large volume of the perishable dielectric load causes a comparatively large influence on the at least one resilient member, and a relatively small volume of the perishable dielectric load causes a comparatively small influence on the at least one resilient member.

5. The heater according to claim 4, wherein the volume meter further comprises a pressure-to-force conversion member configured to convert a pressure exerted on the at least one conducting container by the perishable dielectric load into forces influencing the at least one resilient member.

6. The heater according to claim 1, wherein the tuning circuit comprises at least one capacitive element and at least one inductive element which are adjustable in response to the at least one control signal, and the setting of the initial value of the at least one control signal involving assigning an initial setting of the at least one inductive element.

7. The heater according to claim 1, wherein the controller is configured to set the initial value of the at least one control signal on the further basis of at least one of:

a weight estimate of the perishable dielectric load, a density estimate of the perishable dielectric load, a temperature estimate of the perishable dielectric load, and an estimate of a ionic concentration in the perishable dielectric load.

8. A method of thawing/warming a perishable dielectric load, the method comprising:

placing the perishable dielectric load in a heating chamber configured to hold the perishable dielectric load during thawing/warming thereof, generating electromagnetic energy having predefined spectral properties by a transmitter;

producing, via an emitter, an electromagnetic field in the perishable dielectric load which electromagnetic field is based on the electromagnetic energy from the transmitter unit;

adjusting, via a tuning circuit, an overall impedance of the emitter, the tuning circuit and the heating chamber so that the overall impedance matches an output impedance of the transmitter;

measuring the overall impedance during thawing/warming of the perishable dielectric load;

generating, repeatedly, at least one control signal configured to cause the tuning circuit to adjust the overall impedance to match the output impedance of the transmitter, and setting an initial value of the at least one control signal based on an estimate of a volume of the perishable dielectric load.

9. The method according to claim 8, further comprising registering, automatically, a value representing the estimate of the volume of the perishable dielectric load.

10. The method according to claim 8, wherein the tuning circuit comprises at least one capacitive element and at least one inductive element which is adjustable in response to the at least one control signal, and wherein the setting of the initial value of the at least one control signal involves assigning an initial setting of the at least one inductive element.

11. The method according to claim 8, comprising setting the initial value of the at least one control signal on the further basis of at least one of:

a weight estimate of the perishable dielectric load, a density estimate of the perishable dielectric load, a temperature estimate of the perishable dielectric load, and an estimate of a ionic concentration in the perishable dielectric load.

12. A computer program (SW) loadable into the memory of at least one processor, comprising software for controlling the steps of claim 8 when the program is run on the at least one processor.

13. A processor-readable medium, having a program recorded thereon, where the program is to make at least one processor control the steps of claim 8 when the program is loaded into the at least one processor.

* * * * *